US005370964A

United States Patent [19]

Patel et al.

[11] Patent Number: 5,370,964

[45] Date of Patent: Dec. 6, 1994

[54] TONER AGGREGATION PROCESS

[75] Inventors: Raj D. Patel, Oakville; Grazyna E. Kmiecik-Lawrynowicz, Burlington; Michael A. Hopper, Toronto; Melvin D. Croucher, St. Catharines; T. Hwee Ng, Mississauga; William J. Dale, Scarborough, all of Canada

[73] Assignee: Xerox Corporation, Stamford, Conn.

[21] Appl. No.: 158,343

[22] Filed: Nov. 29, 1993

[51] Int. Cl.[5] ..... G03G 9/08

[52] U.S. Cl. ..... 430/137; 523/322; 523/335; 523/339

[58] Field of Search ..... 430/137; 523/322, 335, 523/339

[56] References Cited

U.S. PATENT DOCUMENTS

| | | | |
|---|---|---|---|
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Salripante et al. | 430/137 |
| 5,308,734 | 5/1994 | Salripante et al. | 430/137 |

*Primary Examiner*—Roland Martin
*Attorney, Agent, or Firm*—E. O. Palazzo

[57] ABSTRACT

A process for the preparation of toner comprising:

(i) preparing a pigment dispersion in water, which dispersion is comprised of pigment, an ionic surfactant, and an optional charge control agent;

(ii) shearing the pigment dispersion with a polymeric latex comprised of resin, a counterionic surfactant with a charge polarity of opposite sign to that of said ionic surfactant, and which latex contains a nonionic surfactant thereby forming a homogeneous or a uniform blend;

(iii) heating the above sheared homogeneous blend below about the glass transition temperature (Tg) of the resin to form electrostatically bound toner size aggregates;

(iv) reshearing the above electrostatically bound toner aggregates (iii) to fragment or break down said toner aggregates of (iii) into smaller average diameter particle size;

(v) heating the resulting formed sheared homogeneous blend (iv) comprised of resin, pigment particles, and the ionic, counterionic and nonionic surfactants in water below about the glass transition temperature (Tg) of the resin while continuously stirring at about 450 to about 800 revolutions per minute to form electrostatically bound toner size aggregates with a narrow particle size distribution;

(vi) adding further ionic or nonionic surfactant in an amount of from about 0.1 to about 10 percent by weight of water to minimize further growth or enlargement of the particles in the coalescence step (vii); and (vii) heating the formed statically bound aggregated particles of (vi) about above the Tg of the resin to provide coalesced particles of toner (viii) separating said toner; and (ix) drying said toner.

43 Claims, No Drawings

TONER AGGREGATION PROCESS

BACKGROUND OF THE INVENTION

The present invention is generally directed to toner processes, and, more specifically, to aggregation and coalescence processes for the preparation of toner compositions. In embodiments, the present invention is directed to the economical preparation of toners without pulverization and/or classification methods, and wherein toner compositions with an average volume diameter of from about 1 to about 25, preferably from 1 to about 10, and more preferably from about 3 to about 7 microns in average volume diameter, and narrow GSD of, for example, from about 1.16 to about 1.26 as measured on the Coulter Counter can be obtained. The resulting toners can be selected for known electrophotographic imaging and printing processes, including color processes, and lithography. In embodiments, the present invention is directed to a process comprised of dispersing a pigment, and optionally a charge control agent or additive in an aqueous mixture containing an ionic surfactant in an amount of from about 0.01 percent (weight percent throughout unless otherwise indicated) to about 10 percent, and shearing this mixture at high speeds, for example in the range of about 3,000 to about 15,000 rpm (revolutions per minute) and preferably in the range of from about 5,000 to about 12,000 rpm with a latex mixture comprised of suspended resin particles of from, for example, about 0.01 micron to about 1 micron in average volume diameter in an aqueous solution containing a counterionic surfactant in amounts of from about 0.01 percent to about 10 percent, and nonionic surfactant in an amount of from 0 and preferably 0.1 percent to about 5 percent, thereby causing a flocculation of resin particles, pigment particles and optional charge control particles, followed by heating at about 35° to 5° C., and preferably 20° C. to 5° C. below the resin Tg, which Tg range is generally between about 45° C. to 85° C., and preferably in the range of about 50° C. to 75° C. to form statically bound aggregates of from about 1 micron to about 10 microns in volume average diameter comprised of resin, pigment and optional toner additives like charge control additives. The flocculation or the heterocoagulation of the pigment particles containing ionic surfactant in amounts of about 0.01 percent to about 10 percent, and preferably between about 0.1 percent to about 5 percent with the latex is comprised primarily of resin particles and ionic surfactant mixture comprised of submicron resin particles containing the counterionic surfactant in the amounts of 0.01 percent to 10 percent and preferably between 0.1 percent to 5 percent causes a significant increase in the viscosity of the system, an increase, for example, of from about 4 centipoise to about 3,000 centipoise, resulting in large clusters or flocculants. Without the breakdown of these huge, large clusters or flocculants, a noncontrolled aggregation can be obtained resulting in particle size and GSD of unacceptable or undesirable values. By applying a high shear, for example about 3,000 to about 15,000 rpm and preferably between about 5,000 and 12,000 rpm during step (ii), a homogeneous or a uniform blend which has a whipped cream like consistency is obtained whereby the big clusters or flocculants are broken or reduced to about submicron size. This is followed by heating 30° C. to 5° C., and preferably 25° C. to 5° C. below the resin Tg, which resin Tg is generally in the range of 40° C. to 80° C., and preferably between about 50° C. to about 75° C. to form statically bound aggregates of step (iii) while stirring. The aforementioned increase in viscosity, for example from about 2 centipoise to about 2,000 centipoise, is not only caused by the pigment particles containing ionic surfactant with the latex mixture comprised of submicron resin particles containing the counterionic surfactant coming together, that is charge neutralization, but it is also a function of solids comprised of resin, pigment particles and optionally charge control agent (or volume fraction) loading in step (ii), for example at 20 percent loading, the viscosity can be as high as 10,000 centipoise. Also, the zeta potential of the latex prepared by emulsion polymerization containing resin particles in the anionic/nonionic surfactant can be another factor, for example a latex measured zeta potential of about −100 millivolts can require a larger quantity of the counterionic surfactant to that of the ionic surfactant in the latex for charge neutralization and hence flocculation to occur. Also, the amounts of the ionic to counterionic surfactants employed independent of the solids loading or the zeta potential of the latex can lead to an increase of viscosity, for example using 2:1 molar ratio of cationic to anionic surfactant increases the viscosity from about 2 to about 3,000 centipoise of the blend. With an increase in viscosity, it is important that a minimum shearing time is selected generally, for example, in the range of about 1 to about 60 minutes, and preferably in the range of about 2 to about 30 minutes in step (ii) to obtain a homogeneous, or uniform blend, which has a whipped cream like consistency. It is also important to stir the blend during the aggregation at an effective speed or tip speed during the aggregation step (iii), or it can result in undesired toner particle size and unwanted GSD.

The present invention is particularly directed to processes for correcting or partially reversing the electrostatically bound aggregates of undesired particle size and/or particle size distribution obtained when the blend comprised of latex, pigment optionally charge control agent from about 5 to 25 percent solids in water, and anionic/nonionic/cationic surfactants system has been heated below the resin Tg (step iii) where the resin Tg is generally in the range of 40° C. to 85° C., and preferably in the range of 50° C. to 75° C. by reshearing at a speed of 3,000 to 12,000 rpm (revolutions per minute) and preferably from about 5,000 to 10,000 rpm. The reshearing of the electrostatically bound aggregates of undesired particle size and/or GSD results in the generation of particles which are generally in the range of from about 0.8 to about 2.5 microns in average volume diameter. These particles in embodiments are smaller than the particles of between about 5 and about 20 microns in average volume diameter that can be obtained prior to reshearing. The reshearing not only, for example, creates a particle range of, for example, about 0.8 to about 2.5 microns, somewhere between the original starting materials, generally in the range of 0.05 to 0.4 micron, and 4 to 10 microns, but also creates a state from which aggregation can again be performed to achieve the desired toner particle size and a narrow toner GSD. The process of reshearing and reaggregation can be repeated many times, for example up to 10, providing, for example, that no final fusion or coalescence step (vii) of the electrostatically bound aggregates has occured. The reshearing is effective in breaking down the electrostatically bound aggregates providing the aggregation temperature in step (iii) is below the temperature where the resin begins to flow, thereby a fusion or coalescence has occured.

In another embodiment thereof, the present invention is directed to an in situ process comprised of first dispersing a pigment, such as HELIOGEN BLUE TM or HOSTAPERM PINK TM, in an aqueous mixture containing a cationic surfactant, such as benzalkonium chloride (SANIZOL B-50 TM), utilizing a high shearing device, such as a Brinkmann Polytron, a microfluidizer or sonicator; thereafter shearing at high speeds in the range of from about 3,000 to about 15,000 rpm, and preferably between 5,000 and 12,000 rpm this mixture with a latex of suspended resin particles, such as poly(styrene butadiene acrylic acid), poly(styrene butylacrylate acrylic acid) or PLIOTONE TM, a poly(styrene butadiene), and which particles are, for example, of a size ranging from about 0.01 to about 0.5 micron in average volume diameter as measured by the Brookhaven nanosizer in an aqueous surfactant mixture containing an anionic surfactant, such as sodium dodecylbenzene sulfonate, for example NEOGEN R TM or NEOGEN SC TM, and nonionic surfactant, such as alkyl phenoxy poly(ethylenoxy)ethanol, for example IGEPAL 897 TM or ANTAROX 897 TM, thereby resulting in a flocculation, or heterocoagulation of the resin particles with the pigment particles; pumping the flocculated mixture through the shearing chamber, or zone at very high speeds generally in the range of 3,000 to 15,000 and preferably between 5,000 to 12,000 rpm; and continuously recirculating for from about 1 to about 120 minutes while being stirred at 200 rpm in a holding tank. This shearing action produces a homogeneous or a uniform blend, which has a whipped cream like consistency as opposed to a cottage cheese like consistency, normally achieved due to the lack of shearing. The length or the time of shearing and the type of consistency achieved is an important factor in determining the particle size and GSD when the aggregation of the blend is performed in step (iii). The blend comprises very small, submicron in size, thus is below about 1 micron, clusters of resin particles, pigment and optionally charge control agents, which particles are then allowed to grow by heating the mixture from about 25° C. to about 5° C. below the resin Tg, which resin Tg is preferably in the range of about 45° C. to about 85° C., and preferably in the range of about 50° C. to about 75° C. to speed up to 10 times, as described in copending application U.S. Ser. No. 082,660, the disclosure of which is totally incorporated herein by reference. The growth controlled of the aggregates can be accomplished while stirring at speed of about 150 to about 800 rpm or tip speed of about 80 centimeters/second to about 440 centimeters/second the components of (step iii). This results in the formation of statically bound aggregates ranging in size of from about 0.5 micron to about 10 microns in average diameter size as measured by the Coulter Counter (Multisizer II). When the stirring speed during the formation of the electrostatically bound aggregates in step (iii) is not sufficiently high, for example between about 50 and about 150 rpm corresponding to agitator tip speeds between 30 and 80 centimeters/second, or the length of time of shearing during the blending in step (ii) is not long enough or efficient, undesirable particles sized between 15 and 25 microns in diameter and/or particle size distribution with a GSD in the range of 1.30 to 100 can be obtained when measured on the Coulter Counter. At this stage, the temperature is lowered 10° C. to 25° C. below the resin Tg, which Tg is generally in the range of from about 40° C. to about 85° C. and preferably in the range of 50° C. to 75° C. Shearing is thereupon applied to the electrostatically bound aggregates of the undesired size and/or GSD obtained in step (iii) at speeds of from 3,000 to 15,000 rpm and preferably in the range of 5,000 to 12,000 rpm for a period of 1 to 20 minutes, resulting in breakdown of the aggregates (step iv). The particle size as measured on the Coulter Counter after shearing indicates a size range of from about 0.7 to about 2.5 microns.

The above sheared blend can then be reheated to temperatures of from about 25° C. to about 5° C. below the resin Tg, which resin Tg is preferably in the range of about 45° C. to about 85° C., and preferably in the range of 50° C. to 75° C., while being stirred for an effective period of time, for example from about 1 to about 6 hours, at an increased speed of from about 650 to 800 rpm, a tip speed of about 360 to about 440 centimeters/second, reference step (v). The growth and the GSD of the particles is periodically monitored by taking samples thereof and measuring them on the Coulter Counter. If the particle size or the GSD measured at this stage is not as desired, the process of reshearing and reaggregation can be repeated. Upon reaching acceptable or desired particle size and GSD, the stirring speed is reduced from 650 to 200 rpm corresponding to an agitator tip speed of from about 360 to about 110 centimeters/second followed by the addition of extra anionic or nonionic surfactant in the amount of from 0.5 to 5 percent by weight of water to stabilize or "freeze" the aggregate size and GSD formed in the previous steps. Thereafter, heating from about 5° C. to about 50° C. above the resin Tg, which resin Tg is in range of from about 50° C. to about 75° C. is accomplished to provide for particle fusion or coalescence of the polymer, or resin and pigment particles while being stirred; followed by washing with, for example, hot water to remove surfactant, and drying whereby toner particles comprised of resin and pigment with various particle size diameters can be obtained, such as from 1 to 12 microns in average volume particle diameter. The aforementioned toners are especially useful for the development of colored images with excellent line and solid resolution, and wherein substantially no background deposits are present. While not being desired to be limited by theory, it is believed that the flocculation or heterocoagulation is caused by the neutralization of the pigment mixture containing the pigment and cationic surfactant absorbed on the pigment surface with the resin mixture containing the resin particles and anionic surfactant absorbed on the resin particle. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing at high speed, generally in the range of 2,000 to 15,000 rpm and preferably in the range of 3,000 to 12,000 rpm to ensure a homogeneous, uniform or a whipped cream like blend comprised of small, submicron to 1 micron size, clusters or flocks, and thereby forming statically bound aggregate particles by stirring and heating (step iii) 5° C. to 25° C. below the resin Tg, which resin Tg is generally in the range of 45° C. to 85° C., and preferably between 50° C. and 75° C.; reshearing (step iv) whenever particle size and/or GSD is out of specification; reaggregating (v) to form the electrostatically bound aggregates by heating 5° C. to 25° C. below the resin Tg while stirring at the correct speed for a period of 1 to 6 hours to achieve desired particle size and narrow GSD; reducing the stirring speed from 650 to 200 rpm or a tip speed of from about 360 to 110 centimeters/second, and adding between 0.01 and 10 percent by weight of extra anionic/nonionic surfactant (step vi) to freeze the aggregate size achieved earlier; and heating the statically bound aggregates from about 5° C. to about 50° C. above the resin Tg (step vii) at temperatures of from 60° C. to 100° C. to form stable toner composite particles comprised of resin, pigment and optionally charge control agents. Of importance with respect to the processes of the present invention in embodiments, is the application of the high speed shearing devices normally comprised of rotator(s)-stator(s), for example polytrons, homogenizers, Megatrons, disintegrators; high efficiency dispensers and the like are crucial in step (ii) and step (iv) as illustrated herein to achieve a uniform blend initially and to reshear the particles that are out of specification in either particle size by being in the range of 10 to 30 microns in diameter, or out of specification in size distribution with GSDs of, for example, in the range from 1.0 to 100. The out of specification particle size and GSD of the electrostatically bound aggregates may be obtained, for example, when there is a lack of adequate stirring in step (iii). Material that is out of specification can be returned to a state wherein aggregation can once again be performed to achieve the desired particle size and a narrow particle size distribution, which generally is in the range of 1.18 to 1.27, by stirring from about 550 to 800 rpm corresponding to agitator tip speeds of from about 294 to 440 centimeters/-second, and heating in step (v) at a temperature 25° C. to 5° C. below the resin Tg, which Tg is generally in the range of 40° C. to 80° C. and preferably between 50° C to 75° C., reducing the stirring speed from 650 to 200 rpm or tip speed from 360 to 110 centimeters/second, followed by the addition of extra anionic or nonionic surfactant in step (vi) in the amount of from 0.5 to 5 percent by weight of water to stabilize aggregates formed in the previous step (v) and, thereafter, heating 5° C. to 50° C. above the resin Tg in step (vii) to form stable toner composite particles comprised of resin and pigment particles with optionally charge control agent. By reshearing the out of specification particle size and GSD of the electrostatically bound aggregates obtained in step (iii) followed by reaggregation (step vi), the desired particle size and narrow particle size distribution resulted. Also, by reshearing the out of specification particle size and GSD of the electrostatically bound aggregates are eliminated or minimized.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to about 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns and with higher pigment loading, such as from about 5 to about 12 percent by weight of toner, such that the mass of toner layers deposited onto paper is reduced to obtain the same quality of image, and resulting in a thinner plastic toner layer onto paper after fusing, thereby minimizing or avoiding paper curling. Toners prepared in accordance with the present invention enable the use of lower fusing temperatures, such as from about 120° C. to about 150° C., thereby further avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and, which after image formation with small particle size toners of from about 3 to about 5 microns and fixing thereafter, results in a low gloss toner image of from about 1 to about 30 gloss units as measured by the Gardner Gloss metering unit. Alternatively, if higher image gloss is desired, such as from about above 30 to about 60 gloss units as measured by the Gardner Gloss metering unit, higher gloss paper is utilized, such as from about above 30 to about 60 gloss units, and, which after image formation with small particle size toners of the present invention of from about 3 to about 5 microns and fixing thereafter, results in a higher gloss toner image of from about above 30 to about 60 gloss units as measured by the Gardner Gloss metering unit. The aforementioned toner to paper matching can be attained with small particle size toners, such as less than 7 microns and preferably less than 5 microns, such as from about 1 to about 4 microns, such that the pile height of the toner layer(s) is considered low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In such processes, it is usually necessary to subject the aforementioned toners to a classification procedure, such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns lower toner yields are obtained after classification, such as from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments. In addition, by the toner particle preparation process of the present invention in embodiments, small particle size toners of from about 3 microns to about 7 microns can be economically prepared in high yields such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, in column 9, lines 50 to 55, it is indicated that a polar monomer, such as acrylic acid in the emulsion resin, is necessary, and toner preparation is not obtained without the use, for example, of an acrylic acid polar group. The process of the present invention need not utilize polymer polar acid groups, and toners can be prepared with resins, such as poly(styrene-butadiene) or PLIOTONE TM, containing no polar acid groups. Additionally, the process of the '127 patent does not appear to utilize counterionic surfactant and flocculation process as does the present invention, and does not appear to use a counterionic surfactant for dispersing the pigment. In U.S. Pat. No. 4,983,488 is illustrated a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with wide GSD. Furthermore, the '488 patent does not, it is believed, disclose the process of counterionic, for example controlled aggregation is obtained by changing the counterionic strength flocculation as with the present invention. The disadvantages, for example poor GSD are obtained, hence, classification is required resulting in low yields, are illustrated in U.S. Pat. No. 4,797,339, wherein there is disclosed a process for the preparation of toners by resin emulsion polymerization, wherein similar to the '127 patent polar resins of oppositely charges are selected, and wherein flocculation as in the present invention is not disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has advantages over processes with reshearing and freezing in that although one may attain a uniform and homogeneous blend having a whipped cream like consistency during step (ii) other auxiliary equipment, such as stirrer breakdown, loss in temperature control, loss of stirrer speed control, build up of viscosity, and the like result during the formation of electrostatically bound aggregates (step iii), resulting in out of specification particle size and/or GSD. By reshearing (step iv) and reaggregating (step v), one can obtain the desired particle size and narrow GSD without any loss in productivity. This recovery in product is important since it not only eliminates or reduces the loss of product, but also eliminates the additional incurred costs of waste disposal, rendering the process environmentally friendly. Moreover, the process of reshearing and reaggregation allows for changes in terms of particle size and GSD during the process, and allows for correction in the event the wrong quantities of starting materials, for example water, cationic (flocculating) agent, or latex, were added, which when monitored in terms of particle size or GSD can be resheared and reaggregated.

In copending patent application U.S. Ser. No. 082,651, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In copending patent application U.S. Ser. No. 083,146, the disclosure of which is totally incorporated herein by reference, there is illustrated a process for the preparation of toner compositions with a volume median particle size of from about 1 to about 25 microns, which process comprises:

(i) preparing by emulsion polymerization an anionic charged polymeric latex of submicron particle size, and comprised of resin particles and anionic surfactant;

(ii) preparing a dispersion in water, which dispersion is comprised of optional pigment, an effective amount of cationic flocculant surfactant, and optionally a charge control agent;

(iii) shearing the dispersion (ii) with said polymeric latex thereby causing a flocculation or heterocoagulation of the formed particles of optional pigment, resin and charge control agent to form a high viscosity gel in which solid particles are uniformly dispersed;

(iv) stirring the above gel comprised of latex particles, and oppositely charged dispersion particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, optional pigment and optional charge control agent.

In copending patent application U.S. Ser. No. 083,157, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In copending patent application U.S. Ser. No. 082,741, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 082,660, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Ser. No. 083,116, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° C. to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

In U.S. Pat. No. 5,290,654, the disclosure of which is totally incorporated herein by reference, there is illustrated a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,520, the disclosure of which is totally incorporated herein by reference, a process for the preparation of in situ toners comprising an halogenization procedure which chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron, nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution of from about 1.2 to about 1.4, as measured by the Coulter Counter, and which exhibit, for example, low fixing temperature of from about 125° C. to about 150° C., low paper curling, and image to paper gloss matching.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application, U.S. Ser. No. 022,575, the disclosure of which is totally incorporated herein by reference, there is disclosed a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles above the Tg to form said toner composition comprised of polymeric resin, pigment and optionally a charge control agent.

There are believed to be a number of advantages of the present invention as indicated herein, for example, although in many instances these can be attained a homogeneous or uniform blend in an initial blending step (ii) when equipment, operational fault, or error occurs during the execution of the process, there can be obtained out of specification material in terms of particle size and GSD due to breakdown of the stirrer, loss of temperature control or lack of efficient mixing, and by reshearing and reaggregating the material that does not conform to specification, the formation of toners with the desired particle size having a narrow GSD, thereby preventing loss of material and additional incurred cost of waste disposal results. Also, the process of the present invention allows the targeted size and GSD of the final toner to be changed while the process is proceeding provided the aggregates have not been finally coalesced or fused into the final toner form by heating above the Tg of the resin.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture containing pigment particles, and optionally charge control agents and other known optional additives dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation or heterocoagulation; (iii) stirring with optional heating at from about 25° C. to 5° C. below the resin Tg, which resin resin Tg is generally in the range of about 40° C. to about 80° C. and preferably between 50° C. and 75° C., which permits the formation of electrostatically stable aggregates of from about 0.5 to about 5 microns in average volume diameter as measured by the Coulter Counter; (iv) reshearing the above blend (iii) in the event that the particle size and/or GSD of the formed electrostatically bound aggregates of step (iii) is out of specification; (v) reaggregating the resheared blend of the previous step by stirring with optional heating 25° C. to 5° C. below the resin Tg; (vi) reducing the stirring speed followed by the addition of extra anionic or nonionic surfactant in the amount of about 0.5 percent to about 5 percent by weight to the aggregates of step (v) in order to increase their stability and to retain their particle size and particle size distribution during the heating stage; and (vii) coalescing or fusing the aggregate particle mixture by heat to toner composites, or a toner composition comprised of resin, pigment, and charge additive.

In a further object of the present invention, there is provided a process for the preparation of toners with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

Moreover, in a further object of the present invention there is provided a process for the preparation of toners which after fixing to paper substrates result in images with gloss of from about 20 GGU up to 70 GGU as measured by Gardner Gloss meter matching of toner and paper.

In another object of the present invention, there are provided composite polar or nonpolar toner compositions in high yields of from about 90 percent to about 100 percent by weight of toner without resorting to pulverization or classification.

In yet another object of the present invention, there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention, there are provided toners comprised of resin and pigment, and which toners permit low or no paper curl.

Another object of the present invention resides in processes for the preparation of small sized toner particles with narrow GSDs, and excellent pigment dispersion by the aggregation of latex particles with pigment particles dispersed in water and surfactant, and wherein the aggregated particles, of toner size, can then be caused to coalesce by, for example, heating. In embodiments, factors of importance with respect to controlling particle size and GSD include the concentration of the surfactant in the latex, the concentration of the counterionic surfactant used for flocculation, the use of high shear devices, the temperature of aggregation, the solid content, the time and the amount of the surfactant used for "freezing" or retaining the particle size to form the toner composite comprised of resin, pigment and optional charge additive, or other known toner additive. The particle size obtained is generally in the range of from about 3 about 10 microns and the GSD is from about 1.18 to about 1.26.

These and other objects of the present invention are accomplished in embodiments by the provision of toners and processes thereof. In embodiments of the present invention, there are provided processes for the economical direct preparation of toner compositions by an improved and controlled flocculation or heterocoagulation, and coalescence processes, and wherein the amount of cationic surfactant selected can be utilized to control the final toner particle size. In embodiments, the present invention is directed to a process for the preparation of toner with controlled particle size comprising:

(i) preparing a pigment dispersion in water, which dispersion is comprised of pigment, an ionic surfactant, and an optional charge control agent;

(ii) shearing the pigment dispersion with a polymeric latex comprised of resin, a counterionic surfactant with a charge polarity of opposite sign to that of said ionic surfactant, and which dispersion also contains a nonionic surfactant thereby forming a homogeneous or a uniform blend dispersion of flocs comprised of resin, pigment, and optional charge additive;

(iii) heating the above sheared homogeneous blend below the glass transition temperature (Tg) of the resin, and wherein the resin Tg is in the range of about 40° C. to about 85° C., and preferably in the range of about 50° C. to about 75° C. to form electrostatically bound toner size aggregates with an average volume diameter of from about 3 to about 10 microns and a particle size distribution of between 1.10 and 1.30;

(iv) reshearing the above electrostatically bound toner aggregates (iii) at a speed of from about 3,000 to about 15,000 revolutions per minute for a period of from about 1 to about 60 minutes to fragment or break down the toner aggregates of (iii) into smaller average diameter particle size in the range of from about 0.5 to about 2 microns to allow reaggregation (step v) of said fragment particles;

(v) heating the resulting formed sheared homogeneous blend (iv) comprised of resin, pigment particles, toner additives, and surfactants in water below the glass transition temperature (Tg) of the resin while continuously stirring at about 450 to about 800 revolutions per minute, corresponding to an agitator tip speed of between 240 to about 440 centimeters per second to form electrostatically bound toner size aggregates with a narrow particle size distribution;

(vi) adding further ionic or nonionic surfactant in an amount of from about 0.1 to about 10 percent by weight of water to control, prevent, or minimize further growth or enlargement of the particles in the coalescence step (vii);

(vii) heating the formed statically bound aggregated particles of (vi) above the Tg of the resin to provide coalesced particles of toner comprised of resin, pigment and optional charge control agent; and optionally (viii) separating the toner; and (ix) drying the toner.

In embodiments, the present invention is directed to processes for the preparation of toner compositions which comprises initially attaining or generating an ionic pigment dispersion, for example dispersing an aqueous mixture of a pigment or pigments, such as phthalocyanine, quinacridone or Rhodamine B type with a cationic surfactant such as benzalkonium chloride by utilizing a high shearing device such as a Brinkman Polytron, a sonicator or a microfluidizer IKA SD 41 or Dispax-Reactor; thereafter shearing this mixture by utilizing a high speed, high shearing device, such as an IKA SD 41 or Dispax-Reactor, with a suspended resin mixture comprised of polymer particles, such as poly(styrene butadiene) or poly(styrene butylacrylate), and of a particle size ranging from about 0.01 to about 0.5 micron in an aqueous surfactant mixture containing an anionic surfactant such as sodium dodecylbenzene sulfonate and nonionic surfactant; resulting in a homogeneous or uniform blend or a "whipped cream" like consistency resulting from flocculation of the resin particles with the pigment particles caused by the neutralization of anionic surfactant absorbed on the resin particles with the oppositely charged cationic surfactant absorbed on the pigment particle; and stirring the mixture using a mechanical stirrer wherein generally the stirring range is from about 200 to about 1,000 rpm and preferably between 300 to 800 rpm with optional heating, 25° C. to 5° C. below the resin Tg, which resin Tg generally is in the range of about 40° C. to about 80° C. and preferably in the range of 50° C. to 75° C., and allowing the formation of electrostatically stabilized aggregates ranging from about 0.5 micron to about 10 microns, wherein the particle growth is monitored on the Coulter Counter and in the event that the particle size and/or GSD is out of specification the electrostatically formed aggregates are sheared at high speeds, generally in the range of about 3,000 to 10,000 rpm for a period of 1 to 60 minutes and preferably for a period of 2 to 30 minutes; followed by stirring the mixture using a mechanical stirrer wherein generally the stirring range is from about 200 to about 1,000 rpm or at tip speeds from about 110 to 534 centimeters/second and preferably between 450 to 800 rpm (tip speed of about 240 to 440 centimeters/second) with optional heating, 25° C. to 5° C. below the resin Tg, which resin Tg is generally in the range of from between about 40° C. to about 80° C. and preferably in the range of from between about 50° C. to about 75° C. to achieve the desired particle size and narrow GSD; followed by a reduction in speed and then the addition of anionic or nonionic surfactant, about 0.02 percent to about 5 percent by weight of water, to "freeze" or retain the size of those aggregates; and heating from about 60° C. to about 95° C. to provide for particle fusion or coalescence of the polymer, or resin and pigment particles; followed by washing with, for example, hot water to remove surfactant, and drying such as by use of an Aeromatic fluid bed dryer, freeze dryer, or spray dryer, whereby toner particles comprised of resin and pigment with various particle size diameters can be obtained, such as from about 1 to about 10 microns in average volume particle diameter as measured by the Coulter Counter.

Also, in embodiments the present invention is directed to a process for the preparation of toner compositions comprising (i) preparing a pigment dispersion in water, which dispersion is comprised of a pigment in an ionic surfactant;

(ii) shearing the pigment dispersion with a polymeric latex comprised of resin of submicron size in the range of from about 0.1 to about 1 micron average volume diameter, a counterionic surfactant with a charge polarity of opposite sign to that of said ionic surfactant and a nonionic surfactant thereby resulting in a uniform homogeneous blend of flocs with particles of less than or equal to from about 0.5 to about 1 micron in average volume diameter, and which particles are comprised of resin and pigment;

(iii) heating the above sheared homogeneous blend below, from about 25° C. to about 5° C., the glass transition temperature (Tg) of the resin and wherein the Tg of the resin is in the range of from about 40° C. to about 85° C. and preferably in the range of from about 50° C. to about 75° C., while continuously stirring at from about 200 to about 1,000 rpm, or tip speeds from about 110 to about 534 centimeters/second and preferably from about 300 to about 700 revolutions per minute (rpm), or tip speeds of from about 160 to about 373 centimeters/second to form electrostatically bound toner size aggregates;

(iv) reshearing the aggregates formed in step (iii) at speed of from between about 3,000 to about 10,000 rpm for a period of from about 1 minute to about 60 minutes and preferably for a period of from about 2 to about 30 minutes;

(v) heating the above resheared blend at about or below, from about 25° C. to about 5° C., the glass transition temperature (Tg) of the resin and wherein the Tg of the resin is in the range of from about 40° C. to about 85° C. and preferably in the range of from about 50° C. to about 75° C., while continuously stirring at from about 200 to about 1,000, or tip speeds from about 110 to about 534 centimeters/second and preferably from about 450 to about 800 revolutions per minute (rpm), or tip speeds of from about 240 to about 440 centimeters/second to form electrostatically bound toner size aggregates with narrow GSD;

(vi) reducing the stirring to about 200 rpm, or a tip speed to 110 centimeters/second, followed by adding additional anionic or nonionic surfactant, about 0.02 percent to about 5 percent by weight of water, to freeze or retain the size and GSD of the aggregates achieved in step (v); and (vii) heating, for example, at temperatures of about 60° C. to about 105° C., the statically bound aggregated particles above the resin Tg, which Tg is generally in the range of about 40° C. to about 85° C. and preferably in the range of about 50° C. to about 75° C. to provide coalesced particles of a toner composition comprised of polymeric resin, pigment and optionally a charge control agent;

a process for the preparation of toner compositions with controlled particle size comprising:

(i) preparing a pigment dispersion in water, which dispersion is comprised of a pigment of a diameter of from about 0.01 to about 0.3 micron, and an ionic surfactant;

(ii) shearing the pigment dispersion with a latex blend comprised of resin of submicron size of from about 0.01 to about 1 micron, a counterionic surfactant with a charge polarity, positive or negative, and of opposite sign to that of the ionic surfactant and a nonionic surfactant, thereby causing a flocculation or heterocoagulation of the formed particles of pigment, resin and charge control agent to form a uniform dispersion of solids in water and the anionic/nonionic/cationic surfactants;

(iii) heating the above sheared blend at a temperature of from about 25° C. to about 5° C. below the resin Tg, which resin Tg is generally in the range of about 40° C. to about 80° C. and preferably between about 50° C. and about 75° C., while continuously stirring to form electrostatically bound, relatively stable, for Coulter Counter measurements, toner size aggregates;

(iv) reshearing the aggregates formed in step (iii) at speeds of about 3,000 to about 10,000 rpm for a period of 1 to 60 minutes and preferably for a period of 2 to 30 minutes to enable the out of specification particles to, for example, be recycled;

(v) heating the above resheared blend below, from about 25° C. to about 5° C., the glass transition temperature (Tg) of the resin and wherein the Tg of the resin is in the range of from about 40° C. to about 85° C. and preferably in the range of from about 50° C. to about 75° C., while continuously stirring at from about 200 to about 1,000 rpm, or tip speeds of from about 110 to about 534 centimeters/second and preferably from about 450 to about 800 revolutions per minute (rpm), or tip speeds of from about 240 to about 440 centimeters/second to form electrostatically bound toner size aggregates with a desired narrow GSD;

(vi) reducing the stirring speed and then adding extra anionic or nonionic surfactant, about 0.02 percent to about 5 percent by weight of water, to freeze or retain the size and GSD of those aggregates achieved in step (v);

(vii) heating the statically bound aggregated particles at a temperature of from about 5° C. to about 50° C. above the resin Tg, which resin Tg is generally in the range of about 40° C. to about 80° C. and preferably between about 50° C. and about 75° C. to provide mechanically stable toner particles comprised of polymeric resin, pigment and optionally a charge control agent;

(viii) separating the toner particles by filtration; and (ix) drying the toner particles; and a process for the preparation of toner compositions with controlled particle size comprising:

(i) preparing a pigment dispersion in water, which dispersion is comprised of a pigment and an ionic surfactant;

(ii) shearing the pigment dispersion with a latex blend comprised of resin particles of submicron size, a counterionic surfactant with a charge polarity of opposite sign to that of said ionic surfactant and which blend contains a nonionic surfactant thereby causing a flocculation or heterocoagulation of the formed particles of pigment and resin to form a uniform dispersion of solids of resin and pigment in the water, and surfactants;

(iii) heating the above sheared blend below the glass transition temperature (Tg) of the resin particles, while continuously stirring to form electrostatically bound toner size aggregates; and (iv) reshearing the aggregates formed in step (iii) at speeds of from about 3,000 to about 10,000 rpm for a period of 1 to 60 minutes and preferably for a period of 2 to 30 minutes;

(v) heating the above resheared blend at about or below, from about 25° C. to about 5° C., the glass transition temperature (Tg) of the resin and wherein the Tg of the resin is in the range of from about 40° C. to about 85° C. and preferably in the range of from about 50° C. to about 75° C., while continuously stirring at from about 200 to about 1,000 rpm, or tip speeds from about 110 to about 534 centimeters/second and preferably from about 450 to about 800 revolutions per minute (rpm), or tip speeds from about 240 to about 440 centimeters/second to form electrostatically bound toner size aggregates with narrow GSD;

(vi) reducing the stirring speed and then adding extra anionic or nonionic surfactant, about 0.02 percent to about 5 percent by weight of water, to retain the size and GSD of the aggregates achieved in step (v); and (vii) heating the statically bound aggregated particles at about or above the resin Tg, which Tg is in range of from about 40° C. to about 80° C. and preferably from about 50° C. to about 75° C. to provide a toner composition comprised of polymeric resin, and pigment.

Embodiments of the present invention include a process for the preparation of toner compositions with preselected sizes, such as from about 1 to about 25 microns in average volume diameter, comprising:

(i) preparing a pigment dispersion in water, which dispersion is comprised of a pigment, and an ionic surfactant;

(ii) shearing at high speeds the pigment dispersion with a latex mixture comprised of a counterionic surfactant with a charge polarity of opposite sign to that of said ionic surfactant, a nonionic surfactant and resin particles to achieve a homogeneous or uniform blend comprised of resin particles, and pigment particles in water and the above surfactant mixtures;

(iii) stirring in the range of from about 200 to about 1,000 rpm, or tip speeds of from about 110 to about 534 centimeters/second, or tip speeds of from about 240 to about 440 centimeters/second and preferably in the range of 300 to 700 rpm, or tip speeds of from about 160 to about 373 centimeters/second, for about 1 to 4 hours, the homogenized mixture with optional heating at a temperature of from about 25° C. to about 50° C., and below about 25° C. to about 5° C., the resin Tg, which resin Tg is in the range of about 45° C. to about 85° C. and preferably between about 50° C. and about 75° C., thereby causing a flocculation or heterocoagulation of the formed particles of pigment, and resin and to form electrostatically bound toner size aggregates;

(iv) reshearing the aggregates formed in step (iii) at speeds of 3000 to 10,000 rpm for a period of 1 to 60 minutes and preferably for a period of 2 to 30 minutes;

(v) heating the above resheared blend below, from about 25° C. to about 5° C., the glass transition temperature (Tg) of the resin and wherein the Tg of the resin is in the range of from about 40° C. to about 85° C. and preferably in the range of from about 50° C. to about 75° C., while continuously stirring at from about 200 to about 1,000, or tip speeds from about 110 to about 534 centimeters/-second and preferably from about 450 to about 800 revolutions per minute (rpm), or tip speeds of from about 240 to about 440 centimeters/second to form electrostatically bound toner size aggregates with narrow GSD;

(vi) reducing the stirring speed and then adding extra anionic or nonionic surfactant, about 0.02 percent to about 5 percent by weight of water, to freeze or retain the size and GSD of those aggregates achieved in step (v);

(vii) stabilizing the formed aggregates by the addition of extra 0.5 to 10 percent of the total kettle volume of anionic or nonionic surfactant prior to heating above the resin Tg, which resin Tg is in the range of about 45° C. to about 8° C. and preferably between about 50° C. and about 75° C.; and (viii) heating to from about 60° C. to about 95° C. the statically bound aggregated particles, for example about 5° C. to about 50° C. above the resin Tg, which resin Tg (glass transition temperature) is in the range of between about 50° C. to about 80° C. and preferably between about 50° C. to about 75° C. to form a toner composition comprised of polymeric resin, and pigment.

Also, in embodiments the present invention is directed to processes for the preparation of toner which comprises (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture containing a cationic surfactant, such as dialkylbenzene dialkylammonium chloride like SANIZOL B-50 TM available from Kao, or MIRAPOL TM available from Alkaril Chemicals, of from about 0.5 to about 2 percent by weight of water, utilizing a high shearing device, such as a Brinkman Polytron or IKA homogenizer, at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE TM or poly(styrenebutadiene) of from about 88 percent to about 98 percent by weight of the toner, and of about 0.1 micron to about 3 microns polymer particle size in volume average diameter, and counterionic surfactant, such as an anionic surfactant such as sodium dodecylsulfate, dodecylbenzene sulfonate or NEOGEN R TM, from about 0.5 to about 2 percent by weight of water, a nonionic surfactant, such polyethylene glycol or polyoxyethylene glycol nonyl phenyl ether, or IGEPAL 897 TM obtained from GAF Chemical Company, of from about 0.5 to about 3 percent by weight of water, thereby causing a mass flocculation or heterocoagulation of pigment, charge control additive and resin particles; homogenizing or shearing resultant mass flocculants with a high shearing device, such as an IKA SD 41 or IKA Dispax-Reactor, Brinkman Polytron or IKA homogenizer, for low, about 200 to about 800 centipoise, viscosity mixtures, at a speed of from about 3,000 revolutions per minute to about 15,000 revolutions per minute (rpm) and preferably from about 5,000 to 12,000 rpm for a duration of from about 1 minute to about 120 minutes, thereby resulting in a homogeneous mixture of latex and pigment; (iii) stirring the mixture with a mechanical stirrer from about 250 to about 500 rpm with heating to about 25° C. to about 5° C. below the resin Tg of preferably about 50° C. to about 70° C. for 1 to 24 hours to form electrostatically stable aggregates of from about 0.5 micron to about 7 microns in average volume diameter; (iv) adding further anionic surfactant or nonionic surfactant in the amount of from 0.5 percent to 5 percent by weight of the water to stabilize aggregates formed in the previous step (v) heating the statically bound aggregate composite particles of from about 60° C. to about 95° C., that is about 5° C. to about 50° C. above the resin Tg, and for a duration of about 60 minutes to about 600 minutes to form toner sized particles of from about 3 microns to about 7 microns in volume average diameter and with a geometric size distribution of from about 1.18 to about 1.26 as measured by the Coulter Counter; and (vi) isolating the toner sized particles by, for example, washing, filtering and drying thereby providing a composite toner composition. Flow additives to improve flow characteristics and charge additives to improve charging characteristics may then optionally be added by blending with the toner, such additives including AEROSILS® or silicas, metal oxides like tin, titanium and the like, of from about 0.1 to about 10 percent by weight of the toner.

Methods for obtaining the pigment dispersion depends on the form of the pigment utilized. In some instances, when pigments are available in the wet cake or concentrated form containing water, they can be easily dispersed utilizing a homogenizer or stirring. In other instances, pigments are available in a dry form, whereby a dispersion in water is effected by microfluidizing using, for example, a M-110 microfluidizer and passing the pigment dispersion from 1 to 10 times through the fluidizer chamber, or by sonication, such as using a Branson 700 sonicator, with the optional addition of dispersing agents such as the aforementioned ionic or nonionic surfactants.

Illustrative examples of resin or polymer selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); and terpolymers such as poly(styrene-butadiene-acrylic acid), poly(styrene-butadiene-methacrylic acid), PLIOTONE TM available from Goodyear, polyethyleneterephthalate, polypropylene-terephthalate, polybutylene-terephthalate, polypentylene-terephthalate, polyhexalene-terephthalate, polyheptadene-terephthalate, polyoctalene-terephthalate, PLASTHALL TM (Rohm And Hass), CYGAL TM (American Cyanamide), ARMCO TM (Armco Composites), CELANEX TM (Celanese Eng), RYNITE TM (DuPont), STYPOL TM, and the like. The resin particles selected, which generally can be, in embodiments, styrene acrylates, styrene butadienes, styrene methacrylates, or polyesters are present in various effective amounts, such as from about 85 weight percent to about 98 weight percent of the toner, and can be of small average particle size such as from about 0.01 micron to about 1 micron in average volume diameter as measured by the Brookhaven nanosize particle analyzer. Other effective amounts of resin can also be selected. The monomer amount to prepare polymer is selected in effective amounts, such as from about 20 to about 60 weight percent, and preferably from about 30 to about 50 weight percent, with the remainder being primarily water; thus, for example, about 40 grams of monomer like styrene and 60 grams of water can be selected.

The resin particles selected for the process of the present invention can be preferably prepared from emulsion polymerization techniques, and the monomers utilized in such processes can be, for example, styrene, acrylates, methacrylates, butadiene, isoprene, and optionally acid, or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, such as dodecanethiol or carbon tetrabromide, can also be selected when preparing resin particles by emulsion polymerization. Other processes of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®, REGAL 330R®, REGAL 660®, REGAL 660R®, REGAL 400®,REGAL 400R®, and other equivalent black pigments. As colored pigments, there can be selected known cyan, magenta, and yellow. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM, BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments selected are present in various effective amounts, such as from about 1 weight percent to about 65 weight and preferably from about 2 to about 12 percent of the toner.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Nonionic surfactants in amounts of, for example, 0.1 to about 25 weight percent in embodiments include, for example, dialkylphenoxypoly(ethyleneoxy) ethanol, available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is, for example, from about 0.01 to about 10 percent by weight, and preferably from about 0.1 to about 5 percent by weight of monomers used to prepare the resin or polymer.

Examples of ionic surfactants include anionic and cationic surfactants, and wherein examples of anionic surfactants selected for the preparation of toners and the processes of the present invention are, for example, sodium dodecylsulfate (SDS), sodium dodecylbenzene sulfonate, sodium dodecyl naphthalene sulfate, dialkyl benzenealkyl, sulfates and sulfonates, abitic acid available from Aldrich, NEOGEN R TM, NEOGEN SC TM available from Kao, Inc. of Japan, and the like. An effective concentration of the anionic surfactant generally employed is, for example, from about 0.01 to about 10 percent by weight, and preferably from about 0.1 to about 5 percent by weight of monomers for preparation of the toner resin.

Examples of cationic surfactants selected for the toners and processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride) available from Kao Chemicals, and the like, and mixtures thereof. The surfactant is utilized in various effective amounts, such as for example from about 0.1 percent to about 5 percent by weight of monomer selected for preparation of toner polymer. Preferably, the molar ratio of the cationic surfactant used for flocculation to the anionic surfactant used in latex preparation is in the range of from about 0.5 to 4, and preferably from 0.5 to 2.

Examples of surfactants, which are added to the aggregated particles to "freeze" or retain particle size and GSD achieved in the aggregation, can be selected from anionic surfactants, such as sodium dodecylbenzene sulfonate, sodium dodecyl naphthalene sulfate, dialkyl benzenealkyl, sulfates and sulfonates available from Aldrich, NEOGEN R TM, NEOGEN SC TM available from Kao, Inc., and the like. Also, there can be selected nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the anionic or nonionic surfactant generally employed as a "freezing agent" or stabilizing agent is, for example, from about 0.01 to about 30 percent by weight, and preferably from about 0.5 to about 5 percent by weight of the total weight of the aggregated mixture.

Surface additives that can be added to the toner compositions after washing or drying include, for example, metal salts, metal salts of fatty acids, metal oxides, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, iron, ferrites, and the like, reference U.S. Pat. Nos. 3,590,000; 4,937,166 and 4,935,326, the disclosures of which are totally incorporated herein by reference, for example from about 2 percent toner concentration to about 8 percent toner concentration. Imaging methods involve the development of a latent xerographic image on a photoconductive imaging member, reference for example U.S. Pat. No. 4,265,660, the disclosure of which is totally incorporated herein by reference, with the toner obtained by the processes of the present invention; transfer to a suitable substrate, such as paper; and fixing thereto by, for example, heat.

The following Examples are being submitted to further define various species of the present invention. These Examples are intended to be illustrative only and are not intended to limit the scope of the present invention. Also, parts and percentages are by weight unless otherwise indicated.

EXAMPLE I

Aggregation of Styrene/Butylacrylate/Acrylic Acid Latex with Cyan Pigment

Pigment dispersion

549 Grams of the dry pigment PV FAST BLUE TM and 114.6 grams of the cationic surfactant SANIZOL B-50 TM were dispersed in 15,690 grams of water using a microfluidizer (model M-110F by Microfluidics Corporation) at 10,000 psi for a total of 5 passes.

A polymeric latex was prepared by the emulsion polymerization of styrene/butylacrylate/acrylic acid (82/18/2 parts) in a nonionic/anionic surfactant solution (3 percent) as follows: 4,920 grams of styrene, 1,080 grams of butylacrylate, 120 grams of acrylic acid, and 210 grams of dodecanethiol were mixed with 9,000 grams of deionized water in which 135 grams of sodium dodecyl benzene sulfonate anionic surfactant (NEOGEN R TM which contains 60 percent of active component), 129 grams of polyoxyethylene nonyl phenyl ether—nonionic surfactant (ANTAROX 897 TM—70 percent active component), and 60 grams of ammonium persulfate initiator were dissolved. The resulting emulsion was then polymerized at 80° C. for 5 hours. The resulting latex contained 60 percent water, and 40 weight percent solids comprised of styrene/butylacrylate/acrylic acid resin particles (latex). The Tg of the latex dry sample was 55.1° C., as measured on E. I. DuPont DSC; $M_w$=19,700, and $M_n$=7,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles 5,450 Grams of the above PV FAST BLUE TM dispersion was added to 7,800 milliliters of water containing 38.3 grams of the cationic surfactant alkylbenzyldimethyl ammonium chloride (SANIZOL B-50 TM). The resulting mixture was then simultaneously added with 8,500 grams of the above prepared latex into an inline IKA Works Model # DR3-6/6A continuous shearing device (Janke & Kunkel IKA Labortechnik) attached to a 10 gallon reactor containing 7,000 grams of water. The pigment dispersion and the latex were mixed thoroughly by the continuous pumping through the shearing chamber(s) of the shearing device operating at 8,000 rpm for 15 minutes while being recirculated through the holding tank (reactor) and stirred at 70 rpm with an agitator comprised of a single blade. A homogeneous or a whipped cream like consistency blend was obtained. The resulting blend was then heated by raising the temperature of the reactor from room temperature to 45° C. where aggregation was performed for 2 hours, while stirring at 70 rpm, or a tip speed of 97 centimeters/second. After 2 hours at 45° C., the surface of the blend seemed to be motionless indicating inadequate mixing. Attempts to increase the stirring speed failed and resulted in total break down of the stirrer.

Six (6) kilograms of the above blend were removed and its particle size measured on the Coulter Counter. A particle of 6.2 microns diameter with a GSD of 1.51 was measured. One (1) kilogram of the above blend was then resheared using an IKA G45 M polytron at 10,000 rpm for 2 minutes. After performing this reshearing operation, the 1 kilogram of material was transferred into a kettle placed in a heating mantle equipped with a mechanical stirrer and a temperature probe, and a sample taken for particle size measurement. After the reshearing process, the particle diameter as determined by a Coulter Counter was 2.5 microns and the GSD was 1.53. The Coulter Counter evidenced the presence of many (85 percent) fine particles of less then 2 microns in diameter. The temperature of the kettle was then increased from room temperature to 45° C. while being stirred at 500 rpm, or tip speed of 267centimeters/-second (adequate mixing with the surface continuously in motion) where reaggregation was performed for 3 hours. A particle size of 4.0 microns with a GSD of 1.20 was obtained. There was thus a dramatic improvement in the GSD by reshearing and reaggregating.

Coalescence of aggregated particles

After the above aggregation, the stirring speed was reduced from 500 rpm (corresponding to an agitator tip speed of 267 centimeters/second) to 200 rpm (corresponding to an agitator tip speed of 110 centimeters/-second) and 55 milliliters of 20 percent anionic (NEOGEN R TM) surfactant solution containing water were added to the formed aggregates in order to freeze the particle size and GSD. The temperature in the kettle was raised from 45° C. to 80° C. at 1° C./minute. Aggregates of latex and pigment particles were coalesced at 80° C. for 4 hours. After 4 hours of heating, particles of 3.8 microns in average volume diameter with 1.21 GSD were obtained indicating that both the particle size and GSD were retained during the coalescence step. The resulting toner particles were comprised of poly(styrene-co-butylacrylate-co-acrylic acid), 95 percent, and cyan pigment, 5 percent by weight of toner. The toner was then washed by filtration using 20 liters of hot water (50° C.) and dried for 15 minutes on a freeze dryer. The yield of dry toner determined gravimetrically was 95 percent.

EXAMPLE II

Aggregation of Styrene/Butylacrylate/Acrylic Acid Latex with Cyan Pigment

Pigment dispersion

549 Grams of dry pigment PV FAST BLUE TM and 114.6 grams of cationic surfactant SANIZOL B-50 TM were dispersed in 15,690 grams of water using a microfluidizer (model M-110F by Microfluidics Corporation) at 10,000 psi for a total of 5 passes.

A polymeric latex was prepared by the emulsion polymerization of styrene/butylacrylate/acrylic acid (82/18/2 parts)in nonionic/anionic surfactant solution (3 percent) as follows: 4,920 grams of styrene, 1,080 grams of butylacrylate, 120 grams of acrylic acid, and 210 grams of dodecanethiol were mixed with 9,000 grams of deionized water in which 135 grams of sodium dodecyl benzene sulfonate anionic surfactant (NEOGEN R TM which contains 60 percent of active component), 129 grams of polyoxyethylene nonyl phenyl ether—nonionic surfactant (ANTAROX 897 TM —70 percent active component), and 60 grams of ammonium persulfate initiator were dissolved. The emulsion was then polymerized at 80° C. for 5 hours. The resulting latex contained 40 percent solids; the Tg of the latex dry sample was 52.1° C. as measured on an E. I. DuPont DSC; $M_w$=19,600, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 150 nanometers.

Preparation of Toner Size Particles

Preparation of the Aggregated Particles 5,450 Grams of the above PV FAST BLUE TM dispersion were added to 7,800 milliliters of water containing 38.3 grams of the cationic surfactant alkylbenzyldimethyl ammonium chloride (SANIZOL B-50 TM). The resulting mixture was then simultaneously added with 8,500 grams of the above prepared latex into an inline IKA Works Model # DR3-6/6A continuous shearing device (Janke & Kunkel IKA Labortechnik) attached to a 10 gallon reactor containing 7,000 grams of water. The pigment dispersion and the latex were well mixed by the continuous pumping thereof through the shearing IKA chambers operating at 8,000 RPM for 15 minutes while being recirculated through the holding tank and stirred at 96 rpm with an agitator comprised of a twin turbine blade. A homogeneous or a whipped cream like consistency blend was obtained. The blend, a total of 27 kilograms, was then heated by raising the temperature of the reactor from room temperature to 45° C. where the aggregation was performed for 2 hours, while stirring at 96 rpm corresponding to an agitator tip speed of 191 centimeters/second. After 2 hours at 45° C., observation indicated that the blend was not moving significantly indicating inadequate mixing. A Coulter Counter measurement indicated a particle size of 6.5 microns diameter with a GSD of 1.45. Five (5) kilograms of the aggregates were then removed to decrease the reactor volume and the speed of the agitator set to 130 rpm, corresponding to an agitator tip speed of 260 centimeters/second, to improve the efficiency of the mixing. The reactor temperature was then lowered from 45° C. to 30° C. and the aggregate suspension was resheared at 8,000 rpm for a period of 8 minutes. The temperature of the reactor was raised again to 45° C. to perform the reaggregation step while continuously stirred at 130 rpm, corresponding to an agitator tip speed of 260 centimeters/second. The removal of 5 kilograms of material from the reactor and the increased stirring speed allowed for adequate mixing. After 2 hours at 45° C., Coulter Counter measurement indicated a particle size 5.5 microns diameter with a GSD of 1.20. The dramatic improvement in the GSD is effected by utilizing the above reshearing and reaggregating.

Coalescence of Aggregated Particles

After aggregation, the stirring speed was reduced from 110 to 75 rpm and 1,275 milliliters of 20 percent anionic (NEOGEN R TM) surfactant solution containing water were added to the formed aggregates to freeze the particle size and freeze the GSD. The temperature of the reactor was then increased from 45° C. to 80° C. at 1° C./minute. Aggregates of latex and pigment particles were coalesced at 80° C. for 4 hours. After 4 hours of heating, a toner particle size of 5.3 microns with 1.21 GSD was obtained indicating that both the particle size and GSD were retained during the coalescence step. The resulting toner particles were comprised of poly(styrene-co-butylacrylate-co-acrylic acid), 95 percent, and cyan pigment, 5 percent by weight of toner. A small 500 gram batch of the toner particles was then washed by filtration, at the laboratory bench level, using hot water (50° C.) and dried on the freeze dryer. The yield of dry toner particles was 95 percent.

EXAMPLE III

Aggregation of Styrene/Butylacrylate/Acrylic Acid Latex with Cyan Pigment

Pigment dispersion 7.0 Grams of SUN FAST BLUE TM dry pigment and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 parts)in a nonionic/anionic surfactant solution (3 percent) as follows: 352 grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active component), and 4 grams of ammonium persulfate initiator were dissolved. The resulting emulsion was then polymerized at 70° C. for 8 hours. The resulting latex contained 60 percent water and 40 percent solids of the above resin; the Tg of the latex dry sample was 53.1° C. as measured on DuPont DSC; $M_w$=19,000, and $M_n$=6,000 as determined on Hewlett Packard GPC. The zeta potential as measured on Pen Kem Inc. Laser Zee Meter was −85 millivolts. The particle size of the latex as measured on Brookhaven BI-90 Particle Nanosizer was 170 nanometers.

Preparation of Toner Size Particles: (15 percent solids)

Preparation of the Aggregated Particles 208.5 Grams of the SUN FAST BLUE TM dispersion were added to 150 milliliters of water containing 1.5 grams of cationic surfactant alkylbenzyldimethyl ammonium chloride (SANIZOL B-50 TM). This was then simultaneously added with 325 grams of latex into the SD 41 continuous stirring device (Janke & Kunkel IKA Labortechnik) containing 200 grams of water. The pigment dispersion and the latex were well mixed by continuous pumping through the shearing chamber operating at 10,000 rpm for 8 minutes. A homogeneous blend comprising 130 grams of resin and 7 grams of pigment particles was obtained. This blend was than transferred into a kettle equipped with mechanical stirrer and temperature probe, and placed in a heating mantle. The temperature of the kettle was then raised from room temperature to 45° C. where the aggregation was performed while stirring at 400 rpm, or tip speed of 213 centimeters/second. After 80 minutes at 45° C., it was observed that the mixing rate was not adequate since, for example, the surface thereof was just barely moving. A particle size measurement showed aggregates with a particle size of 3.7 and a GSD of 1.85 as measured on the Coulter Counter (the results also showed a secondary shoulder peak of considerable size giving rise to the broad GSD). The temperature of the kettle was lowered to 30° C. and the formed aggregates were resheared at 8,000 rpm for a period of 2 minutes. The aggregation was performed by raising the kettle temperature to 45° C., while stirring at 550 rpm, or a tip speed of 294 centimeters/second. After 1 hour, a sample, 500 grams unless otherwise indicated, was removed and its particle size measured. The size obtained was 3.5 microns in average volume diameter with a GSD of 1.26. Although the GSD improved, the presence of the secondary peak was still noticeable.

Coalescence of Aggregated Particles

After aggregation, 55 milliliters of 20 percent of the anionic surfactant (NEOGEN R TM) were added and the stirring speed was reduced from 550 rpm to 180 rpm, or tip speed of 294 to 96 centimeters/second. The temperature in the kettle was raised from 45° to 85° C. at 1° C./minute. Aggregates of latex and pigment particles were coalesced at 85° C. for 4 hours. After 30 minutes of heating at 85° C., a toner particle size of 3.6 microns in average volume diameter with a GSD of 1.27 was obtained as measured on the Coulter Counter. After 4 hours of heating, toner particles of a size of 3.5 microns with 1.27 GSD were obtained. The resulting toner particles comprised poly(styrene-co-butylacrylate-co-acrylic acid,) 95 percent, and cyan pigment, 5 percent by weight of the toner. The toner was then washed by filtration using 2 liters of hot water (50° C.) and dried on the freeze dryer. The yield of dry toner particles was 95 percent.

EXAMPLE IV

Aggregation of Styrene/Butadiene/Acrylic Acid Latex with Cyan Pigment: Pigment Dispersion 14 Grams of dry pigment SUN FAST BLUE TM and 2.92 grams of cationic surfactant SANIZOL B-50 TM were dispersed in 400 grams of water at 4,000 rpm using a polytron.

The polymeric latex was prepared by the emulsion polymerization of styrene/butadiene/acrylic acid (86/12/2 parts) in a nonionic/anionic surfactant solution (3 percent) as follows: 344 grams of styrene, 48 grams of butadiene, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The resulting emulsion was then polymerized at 70° C. for 8 hours. The resulting latex contained 40 percent solids comprised of the above resin; the Tg of the latex dry sample was 53.0° C. as measured on DuPont DSC; $M_w$=46000, and $M_n$=8,000 as determined on Hewlett Packard GPC. The zeta potential as measured on Pen Kem Inc. Laser Zee Meter was −85 millivolts. The particle size of the latex as measured on Brookhaven BI-90 Particle Nanosizer was 160 nanometers.

Preparation of Toner Size Particles

Preparation of the Aggregated Particles

417 Grams of the above prepared SUN FAST BLUE TM dispersion were added to 600 milliliters of water containing 2.92 grams of cationic surfactant alkylbenzyldimethyl ammonium chloride (SANIZOL B-50 TM). This dispersion was then simultaneously added with 650 grams of the above prepared latex into the SD 41 continuous stirring device (Janke & Kunkel IKA Labortechnik) containing 600 grams of water. The pigment dispersion and the latex were well mixed by the continuous pumping thereof through the IKA shearing chamber operating at 10,000 rpm for 8 minutes. A homogeneous blend comprised of resin particles, and pigment particles was obtained. This blend was than discharged and split into two, each having a charge of 1,050 grams. Both kettles A and B were placed in the heating mantles, and equipped with mechanical stirrers and temperature probes. The temperature in the kettles was then raised from room temperature to 45° C. where aggregation was performed, while stirring.

Kettle (A)

The contents of kettle (A) was stirred at 450 rpm, or tip speed of 240 centimeters/second, and provided aggregates with a particle size of 5.7 and a GSD of 1.52 after 1 hour at 45° C., as measured on the Coulter Counter. The kettle was cooled down to room temperature, about 25° C., and the contents resheared at 8,000 rpm for 2 minutes, followed by reaggregation at 45° C. while being stirred at 600 rpm, or tip speed of 320 centimeters/second. After 30 minutes at 45° C., a particle size of 4.2 microns with a GSD of 1.19 was obtained Kettle (B)

Kettle (b) was stirred at 500 rpm, or tip speed of 267 centimeters/second, and provided aggregates with a particle size of 6.3 with a GSD of 1.48. After 1 hour at 45° C., the kettle was cooled down to room temperature and the contents resheared at 8,000 rpm for 2 minutes, followed by reaggregation at 45° C. while being stirred at 600 rpm, or a tip speed of 320 centimeters/second. After 30 minutes at 45° C., a particle size of 4.2 microns with a GSD of 1.19 was obtained.

Coalescence of Aggregated Particles

After aggregation, 65 milliliters of 20 percent anionic surfactant (NEOGEN R TM) each were added to both kettles (A and B) and the stirring speed reduced from 600 rpm to 200 rpm, or a tip speed from about 320 to 110 centimeters/second. The temperature in both the kettles was raised from 45° C. to 90° C. at 1° C./minute. Aggregates of latex and pigment particles were coalesced at 90° C. for 4 hours. After 4 hours of heating, particles of 4.4 microns size with 1.20 GSD were obtained in kettle (A), while kettle (B) provided particles of 4.3 microns size with 1.20 GSD.

The resulting toner particles were comprised of poly(styrene-co-butadiene-co-acrylic acid), 95 percent, and cyan pigment, 5 percent by weight of toner. The toner particles were then washed by filtration using hot water (50° C.) and dried on the freeze dryer. The yield of dry toner particles was 95 percent.

EXAMPLE V

Aggregation of Styrene/Butylacrylate/Acrylic Acid Latex with Magenta Pigment

Pigment Dispersion

14 Grams of dry pigment SUN FAST RED TM (36.1 grams of concentrate containing 40 percent pigment) and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 (parts) in nonionic/anionic surfactant solution (3 percent) as follows: 352 grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent solids; the Tg of the latex dry sample was 53.1° C. as measured on an E. I. DuPont DSC; $M_w$=20,200, and $M_n$=5,800 as determined on Hewlett Packard GPC. The zeta potential as measured on Pen Kem Inc. Laser Zee Meter was −85 millivolts. The particle size of the latex as measured on Brookhaven BI-90 Particle Nanosizer was 170 nanometers.

Preparation of Toner Size Particles

Preparation of the Aggregated Particles 215.5 Grams of the above prepared SUN FAST RED TM dispersion were added to 300 milliliters of water containing 2.5 grams of cationic surfactant alkylbenzyldimethyl ammonium chloride (SANIZOL B-50 TM). This was then simultaneously added with 325 grams of latex into the SD 41 continuous stirring device (Janke & Kunkel IKA Labortechnik) containing 300 grams of water. The pigment dispersion and the latex were well mixed by the continuous pumping thereof through the IKA shearing chamber operating at 10,000 rpm for 8 minutes. A homogeneous blend comprised of the above resin particles, and the above pigment particles was obtained. This blend was than transferred into a kettle placed in a heating mantle and equipped with mechanical stirrer and temperature probe. The temperature of the kettle was then raised from room temperature to 45° C. while being stirred at 500 rpm, or a tip speed of 267 centimeters/second where the aggregation was performed. After ½ hour, a build up of viscosity was observed, and the surface of the kettle contents appears to be motionless. Particle size measurements indicate that both the particle size (7.4 microns average volume diameter) and GSD (1.67) were out of specification. The kettle temperature was lowered to room temperature and then the contents thereof were resheared, followed by reaggregation at 45° C. to form electrostatically bound aggregates toner size particles while being stirred at 650 rpm, or a tip speed of 360 centimeters/-second. After 40 minutes at 45° C., a sample, 500 grams, was removed and the particle size measured on the Coulter Counter as 4.4 microns diameter with a GSD of 1.23.

Coalescence of Aggregated Particles

After aggregation, 55 milliliters of 20 percent anionic surfactant (NEOGEN R TM) were added and the speed was reduced from 650 rpm to 200 rpm, or a tip speed of from 360 to 110 centimeters/second. The temperature of the kettle was then raised from 45° C. to 85° C. at 1° C. per minute. Aggregates of latex and pigment particles were coalesced at 85° C. for 4 hours. The particle size of 4.7 microns with a GSD of 1.22 was measured after 5 minutes of heating at 85° C. After 4 hours of heating, toner particles of 4.6 microns with 1.22 GSD were measured on the Coulter Counter, indicating that both the particle size and GSD were retained during the coalescence step. The resulting toner particles were comprised of poly(styrene-co-butylacrylate-co-acrylic acid), 90 percent, and magenta pigment, 10 percent by weight of toner. The toner particles were then washed by filtration using 1 liter of hot water (50° C.) and dried on the freeze dryer. The yield of dry toner particles determined gravimetrically was 93 percent.

EXAMPLE VI

Aggregation of Styrene/Butylacrylate/Acrylic Acid Latex with Yellow Pigment

Pigment Dispersion 14.0 grams of dry or 36 grams of concentrate (40 percent pigment solids) of SUN FAST YELLOW TM pigment and 1.46 grams of cationic surfactant SANIZOL B-50 TM were dispersed in 200 grams of water at 4,000 rpm using a blender.

A polymeric latex was prepared by the emulsion polymerization of styrene/butylacrylate/acrylic acid (82/18/2 parts) in a nonionic/anionic surfactant solution (3 percent) as follows: 352 grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The resulting emulsion was then polymerized at 70° C. for 8 hours. The resulting latex contained 40 percent solids of the above resin; the Tg of the latex dry sample was 53.1° C. as measured on DuPont DSC; $M_w$=20,200, and $M_n$=5,800 as determined on Hewlett Packard GPC. The zeta potential as measured on Pen Kem Inc. Laser Zee Meter was −85 millivolts. The particle size of the latex as measured on Brookhaven BI-90 Particle Nanosizer was 170 nanometers.

Preparation of Toner Size Particles

Preparation of the Aggregated Particles 215.5 Grams of the above prepared SUN FAST YELLOW TM dispersion were added to 300 milliliters of water containing 2.5 grams of cationic surfactant alkylbenzyldimethyl ammonium chloride (SANIZOL B-50 TM). This mixture was then simultaneously added with 325 grams of latex into the SD 41 continuous stirring device (Janke & Kunkel IKA Labortechnik) containing 300 grams of water. The pigment dispersion and the latex were well mixed by the continuous pumping through the IKA shearing chamber operating at 10,000 rpm for 8 minutes. A homogeneous blend comprised of resin particles and pigment particles was obtained. This blend was than transferred into a kettle placed in a heating mantle and equipped with mechanical stirrer and temperature probe. The temperature of the kettle was then raised from room temperature to 45° C. while being stirred at 500 rpm, or tip speed of 267 centimeters/second where the aggregation was performed. After 0.5 hour, particle size measurements indicated a presence of a secondary shoulder (undesired), and an average volume diameter size of 4.8 microns with a GSD of 1.22 was obtained. The kettle temperature was lowered to room temperature and then resheared (to remove the secondary peak), followed by reaggregation at 45° C. to form the electrostatically bound aggregates toner size particles while being stirred at 600 rpm, or a tip speed of 320 centimeters/second. After 30 minutes at 45° C., a sample was removed and measured for particle size which was 4.5 microns with a GSD of 1.19.

Coalescence of Aggregated Particles

After aggregation, 65 milliliters of 20 percent anionic surfactant (NEOGEN R TM) were added and and the stirring speed was reduced from 600 rpm to 200 rpm, or tip speed from about 320 to 110 centimeters/second. The temperature in the kettle was raised from 45° C. to 85° C. at 1° C./minute. Aggregates of latex and pigment particles were coalesced at 85° C. for 4 hours. After 4 hours of heating, particles of 4.7 microns size with a 1.19 GSD were obtained indicating that both the particle size and GSD were retained during the coalescence step. The resulting toner particles were comprised of poly(styrene-co-butylacrylate-co-acrylic acid), 90 percent, and the above yellow pigment, 10 percent by weight of toner. The toner particles were then washed by filtration using hot water (50° C.) and dried on the freeze dryer. The yield of dry toner particles was 95 percent.

The following Table summarizes some of the experimental data for the above six Examples. The table illustrates that in the event that the particle size and/or particle size distribution of electrostatically bound aggregates obtained in step (iii) is out of specifications, then upon reshearing (step iv), followed by reaggregation (step v) there is obtained the desired toner particle size and narrow GSD. Examples I to V illustrate primarily the improvement in the the GSD of the toner particles, while Example VI illustrates correcting for the undesired aggregates twice the size of the major component that provides the peak in the particle number-size distribution.

| EXAMPLE NO. | AGGREGATE PARTICLE SIZE/GSD (STEP iii) | RESHEAR/ REAGGREGATE PS/GSD (STEP v) | COALESCENCE |
|---|---|---|---|
| I | 6.2/1.51 | 4.0/1.20 | 3.8/1.21 |
| II | 6.5/1.45 | 5.5/1.20 | 5.3/1.21 |
| III | 3.8/1.85 | 3.5/1.26 | 3.5/1.27 |
| IVA | 5.7/1.52 | 4.2/1.19 | 4.4/1.20 |
| IVB | 6.3/1.48 | 4.2/1.19 | 4.3/1.20 |
| V | 7.4/1.67 | 4.4/1.23 | 4.6/1.22 |
| VI | 4.8 (s)/1.22 | 4.5 (ns)/1.19 | 4.7/1.19 |

(s) = secondary shoulder on the main peak
(ns) = no secondary peak observed

Other modifications of the present invention may occur to those skilled in the art subsequent to a review of the present application and these modifications, including equivalents thereof, are intended to be included within the scope of the present invention.

What is claimed is:

1. A process for the preparation of toner comprising:

(i) preparing a pigment dispersion in water, which dispersion is comprised of pigment, an ionic surfactant, and an optional charge control agent;

(ii) shearing the pigment dispersion with a polymeric latex comprised of resin, a counterionic surfactant with a charge polarity of opposite sign to that of said ionic surfactant, and which latex contains a nonionic surfactant thereby forming a homogeneous or a uniform blend dispersion of flocs comprised of resin, pigment, and optional charge additive;

(iii) heating the above sheared homogeneous blend below about the glass transition temperature (Tg) of the resin to form electrostatically bound toner size aggregates with an average volume diameter of from about 3 to about 10 microns and a particle size distribution (GSD) of between about 1.10 and about 1.30;

(iv) reshearing the above electrostatically bound toner aggregates (iii) to fragment or break down said toner aggregates of (iii) into smaller average diameter particle size in the range of from about 0.5 to about 2 microns to allow reaggregation (step v) of said fragment particles;

(v) heating the resulting formed sheared homogeneous blend (iv) comprised of resin, pigment particles, and the ionic, counterionic and nonionic surfactants in water below about the glass transition temperature (Tg) of the resin while continuously stirring at about 450 to about 800 revolutions per minute corresponding to an agitator tip speed of between 240 and 440 centimeters per second to form electrostatically bound toner size aggregates with a narrow particle size distribution;

(vi) adding further ionic or nonionic surfactant in an amount of from about 0.1 to about 10 percent by weight of water to control, prevent, or minimize further growth or enlargement of the particles in the coalescence step (vii); and (vii) heating the formed statically bound aggregated particles of (vi) about above the Tg of the resin to provide coalesced particles of toner comprised of resin, pigment and optional charge control agent; and optionally (viii) separating said toner; and (ix) drying said toner.

2. A process in accordance with claim 1 wherein said resin Tg of (iii) is in the range of from about 40° C. to about 85° C. and preferably in the range of from about 50° C. to about 75° C.; and said reshearing is accomplished at a speed of from about 3,000 to about 15,000 revolutions per minute.

3. A process in accordance with claim 2 wherein (iv) and (v) are repeated about five times, and until the aggregated particles have a particle size in the range of from about 3 to about 10 microns and a GSD of from between about 1.10 and about 1.27.

4. A process in accordance with claim 1 wherein in (iv) the resheated aggregates are stirred at speeds of from about 450 to about 800 revolutions per minute, or tip speeds of from about 240 to about 440 centimeters/-second to enable a narrow toner particle size distribution of from about 1.18 to about 1.28.

5. A process in accordance with claim 1 wherein in (iv) the sheared aggregates are stirred at speeds of from about 450 to about 800 revolutions per minute, or tip speeds of about 240 to about 440 centimeters/second.

6. A process in accordance with claim 5 wherein the reshearing is accomplished at temperatures in the range of from about 10° C. to about 25° C. below the glass transition temperature (Tg) of the resin, which resin Tg is in the range of from about 40° C. to about 85° C.

7. A process in accordance with claim 2 wherein the reshearing of the electrostatically bound aggregates results in the generation of fine toner particles with an average volume diameter of from about 0.4 to about 1.5 microns as measured on the Coulter Counter and which particles are comprised of resin and pigment particles.

8. A process in accordance with claim 1 wherein a particle size distribution of from between about 1.31 and about 1,000 obtained in (iii) results from low stirring speeds of from about 150 to about 450 rpm.

9. A process in accordance with claim 1 wherein the homogeneous blend (ii) is achieved by shearing the dispersion of the latex, the pigment and oppositely charged surfactants in water at a high speed of from about 5,000 to about 15,000 revolutions per minute.

10. A process in accordance with claim 1 wherein the shearing (ii) of the latex particles, pigment particles and oppositely charged surfactants is achieved with a polytron or a homogenizer.

11. A process in accordance with claim 1 wherein the shearing (ii) of the latex particles, pigment and oppositely charged surfactants is achieved by a continuous shearing device comprising an indefinitely variable gap adjustment of from about 0.1 to about 3 millimeters.

12. A process in accordance with claim 1 wherein the shearing of the latex particles, pigment particles and oppositely charged surfactants of (ii) is achieved with a continuous online homogenizer comprising a 3 stage rotator stator.

13. A process in accordance with claim 1 wherein the shearing (ii) of the latex comprised of resin particles stabilized by ionic surfactant particles, pigment, and oppositely charged surfactants is achieved at a temperature of from about 0° C. to about 35° C.

14. A process in accordance with claim 1 wherein the homogeneous blend of the latex particles, pigment particles and oppositely charged surfactants to obtain narrow particle size distribution of aggregated particles is achieved by shearing at from about 2 minutes to about 120 minutes.

15. A process in accordance with claim 1 wherein the time of shearing (ii) controls the homogeneity of the blend of the latex particles, pigment and ionic, counterionic and nonionic surfactants.

16. A process in accordance with claim 1 wherein the surfactant utilized in preparing the pigment dispersion is a cationic surfactant, and the counterionic surfactant present in the latex mixture is an anionic surfactant.

17. A process in accordance with claim 1 wherein the surfactant utilized in preparing the pigment dispersion is an anionic surfactant, and the counterionic surfactant present in the latex mixture is a cationic surfactant.

18. A process in accordance with claim 1 wherein the pigment dispersion of step (i) is accomplished by homogenizing at from about 1,000 to about 10,000 revolutions per minute and preferably between about 2,000 to about 5,000 revolutions per minute at a temperature of from about 20° C. to about 35° C. for a duration of from about 1 minute to about 120 minutes.

19. A process in accordance with claim 1 wherein the pigment dispersion of (i) is accomplished by an ultrasonic probe at from about 300 watts to about 900 watts of energy at from about 5 to about 50 megahertz of amplitude at a temperature of from about 25° C. to about 55° C., and for a duration of from about 1 minute to about 120 minutes.

20. A process in accordance with claim 1 wherein the dispersion of (i) is accomplished by microfluidization in a microfluidizer or in nanojet for a duration of from about 1 minute to about 120 minutes.

21. A process in accordance with claim 1 wherein the homogenization (ii) is accomplished by homogenizing at from about 1,000 revolutions per minute to about 10,000 revolutions per minute for a duration of from about 1 minute to about 120 minutes.

22. A process in accordance with claim 1 wherein the heating of the blend of latex, pigment, surfactants and optional charge control agent in step (iii) is accomplished at temperatures of from about 20° C. to about 5° C. below the Tg of the resin for a duration of from about 0.5 to about 6 hours.

23. A process in accordance with claim 1 wherein the heating of the statically bound aggregate particles to form toner size composite particles comprised of pigment, resin and optional charge control agent is accomplished at a temperature of from about 10° C. above the Tg of the resin to about 95° C. above the Tg of the resin for a duration of from about 1 hour to about 8 hours.

24. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

25. A process in accordance with claim 1 wherein the resin is selected from the group consisting of poly(styrene-butadiene-acrylic acid), poly(styrene-butadiene-methacrylic acid), poly(styrene-butyl methacrylate-acrylic acid), or poly(styrene-butyl acrylate-acrylic acid), polyethylene-terephthalate, polypropylene-terephthalate, polybutylene-terephthalate, polypentylene-terephthalate, polyhexalene-terephthalate, polyheptadene-terephthalate, poly(styrene-butadiene), and polyoctalene-terephthalate.

26. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol; and which surfactant is selected in an effective amount of from about 0.1 to about 5 percent by weight of the aqueous mixture.

27. A process in accordance with claim 1 wherein the anionic surfactant is selected from the group consisting of sodium dodecyl sulfate, sodium dodecylbenzene sulfate, sodium dodecyl naphthalene sulfate, sodium lauryl sulfate, sodium alkyl naphthalene sulfonate, potassium alkyl sulfonate; and which surfactant is selected in an effective concentration of from about 0.01 to about 10 percent and preferably from about 0.02 to about 5 percent by total weight of aqueous mixture.

28. A process in accordance with claim 1 wherein the cationic surfactant is an alkylbenzalkonium chloride selected in an effective concentration of from about 0.01 to about 10 percent and preferably from about 0.02 to about 2 percent by total weight of the aqueous mixture comprised of resin particles, pigment particles, ionic, counterionic and nonionic surfactants and water.

29. A process in accordance with claim 1 wherein the pigment is carbon black, cyan, yellow, magenta present in the amount of from about 0.1 to about 10 percent by weight, and wherein said pigment optionally is from about 0.01 to about 1 micron in volume average diameter.

30. A process in accordance with claim 1 wherein the resin utilized in (ii) is from about 0.01 to about 3 microns in average volume diameter, and the statically bound aggregate particles formed in (iii) are from about 1 to about 10 microns in average volume diameter.

31. A process in accordance with claim 1 wherein the coalesced toner particles formed in (iv) are from about 1 to about 20 microns in average volume diameter.

32. A process in accordance with claim 1 wherein the toner particles isolated are from about 1 to 20 microns in average volume diameter, and the geometric size distribution thereof is from about 1.15 to about 1.26.

33. A process in accordance with claim 1 wherein the resulting toner is washed with warm water and the surfactants are removed from the toner surface, followed by drying.

34. A process in accordance with claim 1 wherein there is added to the surface of the isolated toner additives of metal salts, metal salts of fatty acids, silicas, metal oxides, or mixtures thereof in an amount of from about 0.1 to about 10 weight percent of the obtained toner particles.

35. A process in accordance with claim 1 wherein the speed of shearing (ii) is in the range of from about 4,000 to about 15,000 revolutions per minute and preferably in the range of from about 6,000 to about 12,000 rpm thereby controlling the homogeneity of the blend of the latex particles, pigment, and oppositely charged surfactants in water.

36. A process in accordance with claim 1 wherein stirring is accomplished continuously at from about 200 to about 1,000 and preferably between about 300 to about 700 revolutions per minute.

37. A process in accordance with claim 1 wherein the electrostatically bound aggregated particles are heated to a temperature of from about 5° C. to about 50° C. above the resin Tg (step vii), which resin Tg is in range of from about 40° C. to about 85° C.

38. A process in accordance with claim 9 wherein said speed is from about 6,000 to about 12,000.

39. A process in accordance with claim 1 wherein the particle size of the formed toner is from about 1 to about 25 microns in volume median diameter size.

40. A process in accordance with claim 1 wherein the particle size of the formed toner is from about 3 to about 7 microns in average volume diameter.

41. A process in accordance with claim 1 wherein subsequent to (iv) the following steps are accomplished;

(viii) separating said toner particles from water and surfactant by filtration; and (ix) drying said toner particles.

42. A process for the preparation of toner comprising:

(i) preparing a pigment dispersion in water, which dispersion is comprised of a pigment of a diameter of from about 0.01 to about 1 micron, and an ionic surfactant;

(ii) shearing the pigment dispersion with a latex blend comprised of resin of submicron size of from about 0.01 to about 1 micron, a counterionic surfactant with a charge polarity of opposite sign to that of said ionic surfactant and a nonionic surfactant thereby causing a flocculation or heterocoagulation of the formed particles of pigment, and resin to form a uniform viscous dispersion of solids comprised of resin and pigment particles in a combined content of from about 5 percent to about 25 percent in the water and anionic/nonionic/cationic surfactant system;

(iii) heating the sheared blend of latex and pigment particles at a temperature of equal to or from about 25° C. to about 5° C. below the Tg of the resin, which resin Tg is in the range of about 40° C. to about 85° C. and preferably is in the range of from about 50° C. to about 75° C., while continuously stirring at about 150 to 450 revolutions per minute to form electrostatically bound toner size aggregates;

(iv) reshearing the above electrostatically bound toner aggregates (iii) and which aggregates possess an undesirable, or out of specification broad particle size distribution of from about 1.30 to about 3.00;

(v) heating the above sheared homogeneous blend equal to or below the glass transition temperature (Tg) of the resin particles while continuously stirring at about 450 to 800 rpm, or tip speeds of about 240 to about 440 centimeters/second to form electrostatically bound toner size aggregates with a narrow particle size distribution of from about 1.18 to about 1.28;

(vi) adding further anionic or nonionic surfactant in the range of from about 0.1 to about 10 percent by weight of water to control, prevent, or minimize further growth or enlargement of the particles in the coalescence step (vii);

(vii) heating the statically bound aggregated particles at a temperature of from about 5° to about 50° C. equal to or above the resin Tg, which Tg is in the range of from about 40° C. to about 80° C. to provide a mechanically stable toner composition comprised of polymeric resin, and pigment; and optionally (vii) separating said toner particles from the water by filtration, and (ix) drying said toner particles.

43. A process in accordance with claim 42 wherein said resin Tg of (iii) is in the range of from about 40° C. to about 85° C. and preferably in the range of from about 50° C. to about 75° C., said speed of reshearing is from about 3,000 to about 15,000 revolutions per minute accomplished for a period of from about 1 to about 60 minutes.

* * * * *